US006773648B2

(12) United States Patent
Luo et al.

(10) Patent No.: US 6,773,648 B2
(45) Date of Patent: Aug. 10, 2004

(54) MELTBLOWN PROCESS WITH MECHANICAL ATTENUATION

(75) Inventors: Mengkui Luo, Tacoma, WA (US); Vincent A. Roscelli, Edgewood, WA (US); Senen Camarena, DuPont, WA (US); Amar N. Neogi, Kenmore, WA (US); John S. Selby, Edgewood, WA (US)

(73) Assignee: Weyerhaeuser Company, Federal Way, WA (US)

( * ) Notice: Subject to any disclaimer, the term of this patent is extended or adjusted under 35 U.S.C. 154(b) by 115 days.

(21) Appl. No.: 10/120,964

(22) Filed: Apr. 10, 2002

(65) Prior Publication Data

US 2002/0160186 A1 Oct. 31, 2002

Related U.S. Application Data

(63) Continuation-in-part of application No. PCT/US01/12554, filed on Apr. 17, 2001, which is a continuation-in-part of application No. 09/768,741, filed on Jan. 23, 2001, now Pat. No. 6,471,727, which is a continuation of application No. 09/256,197, filed on Feb. 24, 1999, now Pat. No. 6,210,801, which is a continuation-in-part of application No. 09/185,423, filed on Nov. 3, 1998, now Pat. No. 6,306,334.

(60) Provisional application No. 60/198,837, filed on Apr. 21, 2000.

(51) Int. Cl.[7] ..... B32B 31/08; B29C 47/88

(52) U.S. Cl. ..... 264/172.19; 264/173.1; 264/177.11; 264/177.17; 264/198; 264/211.11; 264/211.12

(58) Field of Search ..... 264/177.11, 177.17, 264/198, 561, 187, 555, 557, 173.1, 172.19, 211.1, 211.11, 211.12, 210.7, 210.8

(56) References Cited

U.S. PATENT DOCUMENTS

| | | | |
|---|---|---|---|
| 2,978,446 | A | 4/1961 | Battista et al. |
| 3,023,104 | A | 2/1962 | Battista |
| 3,141,875 | A | 7/1964 | Battista et al. |
| 3,251,824 | A | 5/1966 | Battista |
| 3,255,071 | A | 6/1966 | Kleinert |
| 3,388,119 | A | 6/1968 | Cruz |
| 3,539,365 | A | 11/1970 | Durand et al. |
| 3,632,469 | A | 1/1972 | Wilder |
| 3,652,387 | A | 3/1972 | Wilder |
| 3,833,438 | A | 9/1974 | Kaneko et al. |
| 3,959,421 | A | 5/1976 | Weber et al. |
| 3,974,251 | A | 8/1976 | Cremer et al. |

(List continued on next page.)

FOREIGN PATENT DOCUMENTS

| | | | |
|---|---|---|---|
| EP | 0 785 304 | A2 | 7/1997 |
| FR | 2735794 | A1 | 12/1996 |
| GB | 2 337 957 | A | 8/1999 |
| JP | 6-220213 | A | 8/1994 |
| JP | 623 4881 | | 8/1994 |
| JP | HEI 6-16222 | | 8/1995 |
| WO | WO 94/28218 | | 12/1994 |
| WO | WO 95/21901 | | 8/1995 |
| WO | WO 95-33883 | | 12/1995 |

(List continued on next page.)

OTHER PUBLICATIONS

Author unknown, "Meltblown Process," "Meltblown Markets," "Meltblown vs. Competitive Technologies," 1989 pp. 7–26.

"Dissolving Pulping Conditions," *Pulp and Paper Manufacture*, 3rd Edition, 4:229–243, Ingruber O.V. et al. Eds., Joint Textbook Committe of the Paper Industry publishers, 1985.

(List continued on next page.)

*Primary Examiner*—Cynthia Kelly
*Assistant Examiner*—J. M. Gray
(74) *Attorney, Agent, or Firm*—Christensen O'Connor Johnson Kindness PLLC

(57) ABSTRACT

Cellulose containing dope is extruded through orifices and into a stream of gas moving in a direction generally parallel to the direction that the filaments are formed with varying degrees of mechanical attenuation provided to the filaments using a take-up device, such as a winder.

11 Claims, 6 Drawing Sheets

U.S. PATENT DOCUMENTS 4,142,913 A 3/1979 McCorsley et al.
4,144,080 A 3/1979 McCorsley
4,145,532 A 3/1979 Franks et al.
4,159,345 A 6/1979 Takeo et al.
4,196,282 A 4/1980 Franks et al.
4,211,574 A 7/1980 McCorsley et al.
4,246,221 A 1/1981 McCorsley
4,256,613 A 3/1981 Franks et al.
4,290,815 A 9/1981 Henry
4,324,593 A 4/1982 Varga
4,416,698 A 11/1983 McCorsley
4,426,228 A 1/1984 Brandner et al.
4,440,700 A 4/1984 Okada et al.
4,581,072 A 4/1986 Laity
4,634,470 A 1/1987 Kamide et al.
4,939,016 A 7/1990 Radwanski et al.
5,075,068 A 12/1991 Milligan et al.
5,094,690 A 3/1992 Zikeli et al.
5,189,152 A 2/1993 Hinterholzer et al.
5,216,144 A 6/1993 Eichinger et al.
5,242,633 A 9/1993 Rook et al.
5,252,284 A 10/1993 Jurkovic et al.
5,260,003 A 11/1993 Nyssen et al.
5,277,857 A 1/1994 Nicholson et al.
5,310,424 A 5/1994 Taylor
5,326,241 A 7/1994 Rook et al.
5,330,567 A 7/1994 Zikeli et al.
5,362,867 A 11/1994 Chin et al.
5,370,322 A 12/1994 Gray et al.
5,401,304 A 3/1995 Wykes et al.
5,401,447 A 3/1995 Matsui et al.
5,403,530 A 4/1995 Taylor
5,413,631 A 5/1995 Gray et al.
5,417,909 A 5/1995 Michels et al.
5,421,525 A 6/1995 Gray et al.
5,453,194 A 9/1995 Kelin
5,486,230 A 1/1996 Kalt et al.
5,507,983 A 4/1996 Sellars et al.
5,520,869 A 5/1996 Taylor
5,527,178 A 6/1996 White et al.
5,540,874 A 7/1996 Fukui et al.
5,543,101 A 8/1996 Ruf et al.
5,543,511 A 8/1996 Bergfeld et al.
5,545,371 A 8/1996 Lu
5,556,452 A 9/1996 Kalt et al.
5,562,739 A 10/1996 Urben
5,580,354 A 12/1996 Taylor
5,580,356 A 12/1996 Taylor
5,582,783 A 12/1996 Zikeli et al.
5,582,786 A 12/1996 Brunskill et al.
5,582,843 A 12/1996 Sellars et al.
5,587,238 A 12/1996 Meraldi et al.
5,589,125 A 12/1996 Zikeli et al.
5,591,388 A 1/1997 Sellars et al.
5,593,705 A 1/1997 Schilo et al.
5,601,765 A 2/1997 Sellars et al.
5,601,771 A 2/1997 Ruf
5,603,883 A 2/1997 Zikeli
5,605,567 A 2/1997 Lancaster
5,607,639 A 3/1997 Zikeli et al.
5,609,957 A 3/1997 Page et al.
5,618,483 A 4/1997 Weigel et al.
5,626,810 A 5/1997 Zikeli et al.
5,628,941 A 5/1997 Kalt et al.
5,634,914 A 6/1997 Wilkes et al.
5,639,484 A 6/1997 White et al.
5,651,794 A 7/1997 Taylor
5,652,001 A 7/1997 Perry et al.
5,653,931 A 8/1997 Eibl et al.
5,656,224 A 8/1997 Zikeli et al.
5,662,858 A 9/1997 Firgo et al.
5,676,795 A 10/1997 Wizani et al.
5,679,146 A 10/1997 Kalt et al.
5,690,874 A 11/1997 Bell et al.
5,693,296 A 12/1997 Holtzapple et al.
5,695,377 A 12/1997 Tribes et al.
5,709,716 A 1/1998 Taylor
5,725,821 A 3/1998 Gannon et al.
5,759,210 A 6/1998 Potter et al.
5,760,211 A 6/1998 Schleicher et al.
5,766,530 A 6/1998 Kalt et al.
5,772,952 A 6/1998 Allen et al.
5,779,737 A 7/1998 Potter et al.
5,788,939 A 8/1998 Mulleder et al.
5,795,522 A 8/1998 Firgo et al.
5,902,532 A 5/1999 Pitowski
5,977,346 A 11/1999 Saka et al.
6,001,303 A 12/1999 Haynes et al.
6,042,769 A 3/2000 Gannon et al.
6,197,230 B1 3/2001 Pierre et al.
6,210,801 B1 * 4/2001 Luo et al. ..... 428/393
6,306,334 B1 * 10/2001 Luo et al. ..... 264/561
6,558,610 B1 * 5/2003 Rodgers et al. ..... 264/555
2002/0160186 A1 * 10/2002 Luo et al. ..... 428/364

FOREIGN PATENT DOCUMENTS

WO WO 95/35399 12/1995
WO WO 95/35400 12/1995
WO WO 96/12063 4/1996
WO WO 96/25552 8/1996
WO WO 96/27700 9/1996
WO WO 97/15713 5/1997
WO WO 97/23669 7/1997
WO WO 97/30196 8/1997
WO WO 98/02662 1/1998
WO WO 98/07911 2/1998
WO WO 98/26122 6/1998
WO WO 98/30740 7/1998
WO WO 98/59100 12/1998
WO WO 99/16960 4/1999
WO WO 98/22642 5/1999
WO WO 99/47733 9/1999

OTHER PUBLICATIONS

Balk, H. et al., "Use of Spinbonding and Melt Blown Microfiber Technology for Filter Media," pp. 287–297, TAPPI Proceedings, Nonwoven Conference, 1991.

Boman, R. et al., "Transition Metal Removal Before A (PO) Stage in ECF Sequences," International Pulp Bleaching Conference, 1996.

Bouchard, J. et al., "A Comparison Between Acid Treatment and Chelation Prior to Hydrogen Peroxide Bleaching of Kraft Pulps," Pulp and Paper Research Institute of Canada, 1993.

Chanzy, H. et al., "Dissolution and Spinning of Exploded Wood in Amine Oxide Systems," *Wood and Cellulosics* pp. 573–579, editors Kennedy, J.F. et al., Ellis Harwood Publishers, 1987.

Chanzy, H. et al., "Spinning of Exploded Wood from Amine Oxide Solutions," *Polymer Communications*, 27:171–172, 1986.

Cole, D.J., "Courtaulds Tencel Fibre in Apparel Fabrics," *Courtaulds Fibres*, May, 1992.

Eichinger, D. et al., "Lenzing Lyocell—An Interesting Cellulose Fibre for the Textile Industry," talk held at 34th IFC, Dornbirn, 1995.

Gurnagul, N. et al., "The Effect of Cellulose Degradation on the Strength of Wood Pulp Fibres," Pulp and Paper Research Institute of Canada, 1992.
Hill, R.T. et al., "Transition Metal Control for Peroxygen Bleaching a Sulfite Pulp," pp. 489–500, TAPPI Pulping Conference, Houston, Texas, 1994.
Humphrey, A.E., "The Hydrolysis of Cellulosic Materials to Useful Products," pp. 25–53, *Hydrolysis of Cellulose*, 1978.
Ingruber, O.V., et al. (eds.), *Pulp and Paper Manufacture*, vol. 4, *Sulfite Science & Technology*, 3d ed., Joint Textbook Committee of the Paper Industry, Atlanta, 1985, pp. 229–243.
Johnson, P., "Courtaulds Lyocell—A Cellulosic Fibre for Special Papers and Nonwovens," pp. 245–248, TAPPI Nonwovens Conference, 1996.
Kamide, K. et al., "Structural Change in Alkali–Soluble Cellulose Solid During Its Dissolution Into Aqueous Alkaline Solution," *Cellulose Chem. Technol.*, 24:23–31, 1990.
Kamide, K., et al., "Dissolution of Natural Cellulose into Aqueous Alkali Solution: Role of Super–Molecular Structure of Cellulose," *Polymer Journal* 24:71–86, 1992.
Kruger, I.R. et al., "Cellulosic Filament Yarn From the NMMO Process," Presentation: Int. Chemiefaser–Tagung, Dornbirn, 1993.
Lipinksy, E.S., "Perspectives on Preparation of Cellulose for Hydrolysis," pp. 1–23, *Hydrolysis of Cellulose*, 1978.
Luo, M., "Characterization of Cellulose and Galactomannan Blends from the N–Methylmorpholine N–Oxide/Water Solvent System," State University of New York, Syracuse, New York, Apr., 1994.
Majumbar, B. et al., "Air Drag on Filaments in the Melt Blowing Process," J. Rheol, 34(4):591–601, May 1990.
Marini et al., "Lenzing Lyocell," Presentation: Int. Chemiefaser–Tagung, Dornbirn, 1993.
Michels, C. et al., "The Aminoxide Process Developed in the TITK," Thuringisches Institut fur textil– und Kunstsoff–Forschung Talk, Rudolstadt, Sep., 1994.
Mieck, K. et al., "Examination of the Fibrillation Tendency of Cellulosic Man–Made Spun Fibres with Different Fibre Formation Mechanisms," Presentation: Int. Chemiefaser–Tagung, Dornbirn, 1993.
Mortimer, S.A. et al., "Methods for Reducing the Tendency of Lyocell Fibers to Fibrillate," pp. 305–316, Centre de Recherches sur les Macromolecules Vegetales, Grenoble, France, Mar., 1995.
Nicolai, M. et al., "Textile Crosslinking Reactions to Reduce the Fibrillation Tendency of Lyocell Fibers," *Textile Res. J.* 66(9):575–580, 1996.
Robert, A. et al., "Possible Uses of Oxygen in Bleaching Cellulose Pulps. (2). Bleaching Cellulose Pulps Previously Treated With Oxygen," *ATIP* Bulletin 18, 4:166–176, 1964.
Trimble, L.E., "The Potential for Meltblown," pp. 139–149, presentation, 1989.
Vargas, E. (ed.), *Meltblown Technology Today*, Miller Freeman Publications, San Francisco, 1989, pp. 7–26, 71, 77.
Woodings, C.R., "Fibers (Regenerated Cellulosics)," Encyclopedia of Chemical Technology, Fourth Edition, 10:696–726, John Wiley & Sons publishers, 1993.
Yamashiki, T. et al., "Characterisation of Cellulose Treated by the Steam Explosion Method. Part 1: Influence of Cellulose Resources on Changes in Morphology, Degree of Polymerisation, Solubility and Solid Structure," *British Polymer Journal* 22:73–83, 1990.
Yamashiki, T. et al., "Charcterisation of Cellulose Treated by the Steam Explosion Method. Part 2: Effect on Treatment Conditions on Changes in Morphology, Degree of Polymerisation, Solubility in Aqueous Sodium Hydroxide and Supermolecular Structure of Soft Wood Pulp During Steam Explosion," *British Polymer Journal* 22:121–128, 1990.
Yamashiki, T. et al., "Characterisation of Cellulose Treated by the Steam Explosion Method. Part 3: Effect of Crystal Forms (Cellulose I, II and III) of Original Cellulose on Changes in Morphology, Degree of Polymerisation, Solubility and Supermolecular Structure by Steam Explosion," *British Polymer Journal* 22:201–212, 1990.
Yuan, Z. et al., "The Role of Transition Metal Ions During Peracetic Acid Bleaching of Chemical Pulps," pp. 1–8, 83rd Annual Meeting, Technical Section CPPA, 1997.
Zhang, X. et al., "The Role of Transition Metal Species in Delignification With Distilled Peracetic Acid," *J. Wood Chemistry and Technology* 18(3):253–266, 1998.
Michels, C. et al., "Besonderheiten Des im Titk Entwickelten Aminooxidprozesses" *Lenzinger Berichte*, pp 57–60, Austria, 1994.

* cited by examiner

MELTBLOWN PROCESS WITH MECHANICAL ATTENUATION

CROSS-REFERENCE TO RELATED APPLICATIONS

This application is a continuation-in-part of pending PCT Application No. PCT/US01/12554, filed Apr. 17, 2001, designating the United States, which claims the benefit of Provisional U.S. Application No. 60/198,837, filed Apr. 21, 2000. This application is also a continuation-in-part of U.S. application Ser. No. 09/768,741, filed Jan. 23, 2001 now U.S. Pat. No. 6,471,727, which in turn is a continuation of U.S. application Ser. No. 09/256,197, filed Feb. 24, 1999, now U.S. Pat. No. 6,210,801, which in turn is a continuation-in-part of U.S. application Ser. No. 09/185,423, filed Nov. 3, 1998, now U.S. Pat. No. 6,306,334. These prior applications and patents are expressly incorporated herein by reference.

FIELD OF THE INVENTION

The present invention relates to a process for producing filaments employing a modified meltblown process and more particularly to a process for producing lyocell filaments employing a modified meltblown process that mechanically attenuates the filaments.

BACKGROUND OF THE INVENTION

In the past decade, major cellulose fiber producers have engaged in the development of processes for manufacturing shaped cellulose materials including filament and fibers based on the lyocell process. One process for producing lyocell filaments known as a meltblown process can be generally described as a one step process in which a fluid dope is extruded through a row of orifices to form a plurality of filaments while a stream of air or other gas stretches and attenuates the hot filaments. The latent filaments are treated to precipitate the cellulose. The filaments are collected as continuous filaments or discontinuous filaments. Such a process is described in International Publication No. WO 98/07911 assigned to Weyerhaeuser Company, the assignee of the present application.

Lyocell filaments produced by an existing meltblown process are characterized by variability in diameter along their length, variability in length and diameter from filament to filament, a surface that is not smooth and a naturally imparted crimp. In addition it has been observed that lyocell filaments made by a meltblown process exhibit fibrillation at desirably low levels. These properties of lyocell filaments produced by known meltblown processes make them suitable for applications where such properties are desirable; at the same time these properties make the meltblown lyocell filaments less suitable for other applications where less variability in filament diameter, less natural crimp and higher strength are desired.

Another process for making lyocell filaments is known as dry-jet wet spinning. An example of dry-jet wet processes is described in U.S. Pat. Nos. 4,246,221 and 4,416,698 to McCorsley III. A dry-jet wet process involves the extrusion of a fluid dope through a plurality of orifices to form continuous filaments in an air gap. Usually the air in this gap is stagnant, but sometimes air is circulated in a direction transverse to the direction that the filaments are traveling in order to cool and toughen the filaments. The formed continuous filaments are attenuated in the air gap by a mechanical tensioning device such as a winder. A tensioning device has a surface speed that is greater than the speed at which the dope emerges from the orifices. This speed differential causes the filaments to be mechanically stretched resulting in a reduction in the diameter of the filaments and the strengthening thereof. The filaments are then taken up by a conveyer or other take up device after they have been treated with a non-solvent to precipitate the cellulose and form continuous filaments. These filaments can be gathered into a tow for transport and washing. Staple fibers can be made by cutting a tow of the filaments. Alternatively, the continuous filaments can be twisted to form a filament yarn.

Lyocell filaments formed by a dry-jet wet process are characterized by a smooth surface and little variability in cross-sectional diameter along a filament length. In addition, diameter variability between dry-jet wet filaments is low. Further, lyocell filaments from the dry-jet wet process have little if any crimp, unless the filaments are post-treated to impart such crimp. It is believed that the susceptibility of lyocell filaments made by a dry-jet wet process to fibrillate is greater than the susceptibility of fibers made by known meltblown processes to fibrillate. Therefore, while lyocell filaments made by a dry-jet wet process or lyocell fibers made from such filaments may be preferred for applications where low natural crimp, smooth surfaces, low variability in cross sectional diameter along a fiber and low variability in diameter from fiber to fiber are desirable, they still may be more susceptible to fibrillation compared to lyocell fibers made using known meltblown processes.

As demand for lyocell fibers increases and broadens there is a need for improved methods of producing lyocell fibers that are capable of producing fibers with desirable properties and without those undesirable properties that are imparted to the fibers by existing processes for producing lyocell.

SUMMARY OF THE INVENTION

The present invention provides such an improved method of producing lyocell filaments that includes the steps of extruding a dope through a plurality of orifices into a stream of gas to form substantially continuous elongate filaments. The gas stream attenuates and at times stabilizes the extruded filaments. In addition, in accordance with the present invention, the filaments are mechanically attenuated using a winder or other type of take-up device. The mechanical winder or other take-up device applies an external force to the filaments in a direction parallel to the length of the filaments. This force is in addition to the force applied by the gas stream or gravity. Lyocell filaments produced by a process carried out in accordance with the present invention and lyocell fibers cut from such filaments exhibit desirable properties such as low susceptibility to fibrillation, smooth surfaces, low variability in cross-sectional diameter along the filament or fiber length and from fiber to fiber and little natural crimp. In addition, the filaments and fibers possess strength properties that make them suitable for many applications where lyocell filaments and fibers are presently used or contemplated.

A further advantage of the present invention is that it will enable higher speed spinning of lyocell filaments compared to the speed at which filaments are spun using conventional dry-jet wet or melt blowing processes. Higher speed spinning will result in increased production rates by increasing dope throughput. Alternatively, if dope throughput is not increased, fiber diameter can be decreased.

The degree to which the extruded filament is attenuated by the gas and the degree to which the filament is attenuated mechanically in accordance with the present invention can vary. For example, in certain embodiments it may be preferred that the gas provides most of the attenuation with little mechanical attenuation. In other situations it may be preferred that little attenuation results from introducing the extruded filament into the gas stream and that most of the attenuation be provided mechanically.

Bicomponent cellulose filaments comprising cellulose and other polymers and filaments comprising blends of cellulose and other materials can also be produced using a process carried out in accordance with the present invention by forming dopes from combinations of cellulose with other polymers.

BRIEF DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION OF THE PREFERRED EMBODIMENT

While the preferred embodiment of the invention has been illustrated and described, it will be appreciated that various changes can be made therein without departing from the spirit and scope of the invention. For example in the preferred embodiment air is described as the gas; however, it should be understood that other gases may function equally well. The plurality of orifices needed in accordance with the present invention are described below in the context of a meltblowing head. It should be understood that the description using a meltblowing head is exemplary and that other types of devices that include a plurality of orifices suitable for extruding a dope into filaments would be useful in the present invention.

The following description of an embodiment of the present invention makes reference to the production of lyocell fibers; however it should be understood that the process described below could be carried out using other compositions to make other types of fibers, such as bicomponent fibers formed from a dope of a mixture of cellulose and other polymers.

In order to produce fibers using a method carried out in accordance with the present invention a dope is formed by dissolving cellulose, preferably in the form of wood pulp in an amine oxide, preferably a tertiary amine N-oxide containing a non-solvent for cellulose such as water. The wood pulp can be any of a number of commercially available dissolving or non-dissolving grade pulps from sources such as the Weyerhaeuser Company, assignee of the present application, International Paper Company, Sappi Saiccor sulfite pulp, and prehydrolyzed kraft pulp from International Paper Company. In addition, the wood pulp can be a high hemicellulose, low degree of polymerization pulp as described in U.S. patent application Ser. Nos. 09/256,197 and 09/185,432 and International Publication No. WO 99/47733 which are incorporated herein by reference.

Representative examples of amine oxide solvents useful in the practice of the present invention are set forth in U.S. Pat. No. 5,409,532. The presently preferred amine oxide solvent is N-methyl-morpholine-N-oxide (NMMO). Other representative examples of solvents useful in the practice of the present invention include dimethylsulfoxide (DMSO), dimethylacetamide (DMAC), dimethylformamide (DMF) and caprolactan derivatives. The pulp can be dissolved in amine oxide solvent by any art-recognized means such as are set forth in U.S. Pat. Nos. 5,534,113; 5,330,567 and 4,246,221.

Figure 1:
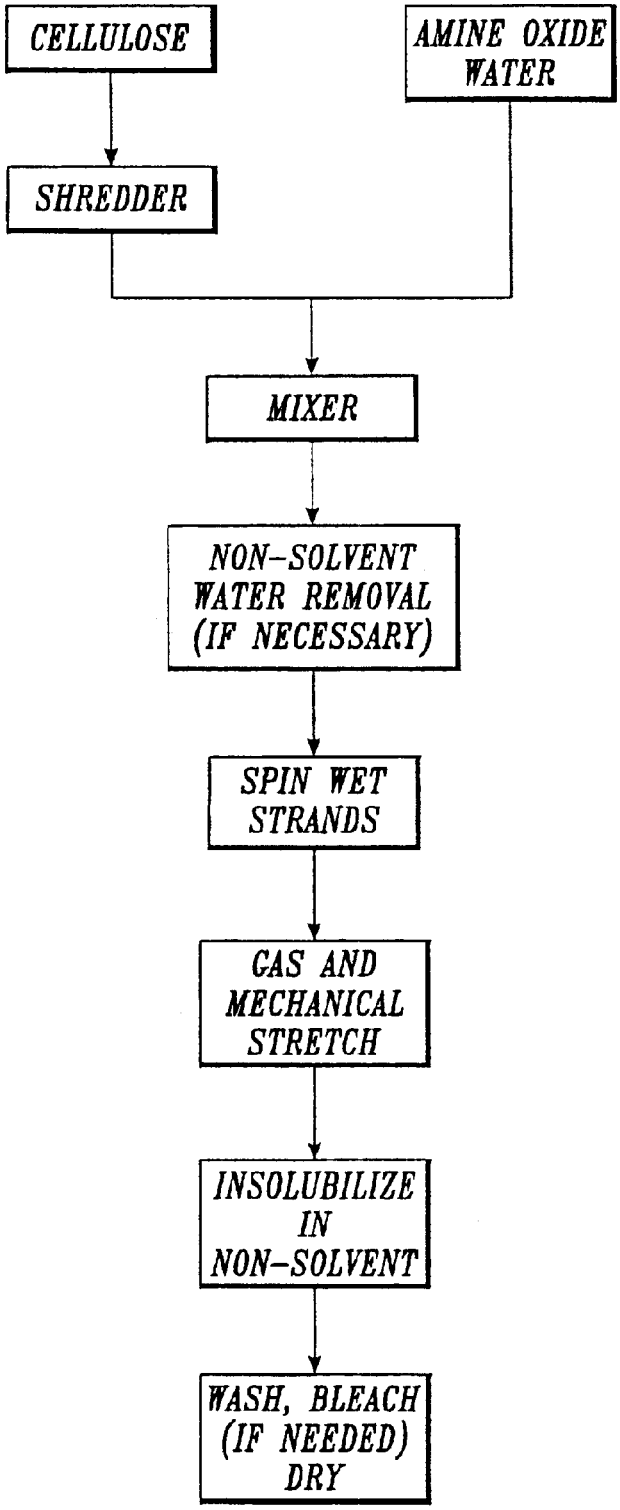
FIG. 1 is a block diagram of the steps of a presently preferred embodiment of forming lyocell filaments in accordance with the present invention.

FIG. 1 shows a block diagram of the presently preferred process for forming lyocell filaments from cellulose dopes. If necessary, the cellulose in the form of pulp is physically broken down, for example by a shredder, before being dissolved in an amine oxide-water mixture to form the dope. The pulps can be dissolved in an amine solvent by any known manner, e.g., as taught in McCorsley U.S. Pat. No. 4,246,221. For example, the pulp can be wet in a nonsolvent mixture of about 40% NMMO and 60% water. The ratio of pulp to wet NMMO can be about 1:5.1 by weight. The mixture can be mixed in a double arm sigma blade mixer for about 1.3 hours under vacuum at about 120° C. until sufficient water has been distilled off to leave about 12%–14% based on NMMO so that a cellulose solution is formed. Alternatively, NMMO of appropriate water content may be used initially to obviate the need for the vacuum distillation. This is a convenient way to prepare spinning dopes in the laboratory where commercially available NMMO of about 40%–60% concentration can be mixed with laboratory reagent NMMO having only about 3% water to produce a cellulose solvent having 7%–15% water. Moisture normally present in the pulp should be accounted for in adjusting necessary water present in the solvent. Reference might be made to articles by Chanzy, H. and A. Peguy, *Journal of Polymer Science, Polymer Physics Ed.* 18:1137–1144 (1980), and Navard, P. and J. M. Haudin, *British Polymer Journal*, p. 174 (December 1980) for laboratory preparation of cellulose dopes in NMMO water solvents.

In accordance with an embodiment of the present invention, the dope is processed through a meltblown head which extrudes the dope through a plurality of orifices into a turbulent air stream moving generally parallel to the direction the dope exits the orifices, rather than directly into an air gap where there is no air flow or an air flow transverse to the direction that dope exits the orifices as in the case of a dry-jet wet process. Parallel air flow describes the flow of air downstream from the point where the dope exits the orifices. As described below in more detail, depending upon the particular configuration of the meltblown head, the air exiting the meltblown head may not necessarily be traveling parallel to the direction that the filaments are traveling; however, at some point downstream from the point where the dope exits the orifices, in accordance with the present invention, the air begins to flow in a direction that is parallel to the direction that the filaments are traveling. The high-velocity air draws or stretches the filaments. This air attenuation differs from mechanical attenuation by providing more variable tension and may not provide a continuous tension due to the turbulence of the air flow. This non-mechanical stretching serves two purposes: it causes some degree of longitudinal molecular orientation and accelerates the filaments rapidly as they leave the nozzle orifice, thus reducing the ultimate fiber diameter. The air stream is also believed to stabilize the latent filament as described below in more detail.

In accordance with the present invention, in addition to the attenuation of the filaments provided by the flowing air stream, additional attenuation of the filaments is accomplished by applying an external force to the filaments in a direction parallel to the length of the filaments where such external force is supplied by something other than the gas stream or gravity. In preferred embodiments, such external force is provided by a mechanical device such as a take-up device in the form of a winder or take-up roll. Such devices provide a mechanical attenuation that complements and is in addition to the attenuation provided by the air stream. In particular embodiments, the latent filaments can be regenerated before they are taken up by the device providing the mechanical attenuation. The process carried out in accordance with the present invention produces substantially continuous elongate filaments which, once they are regenerated, are collected as substantially continuous elongate filaments. Such continuous elongate filaments are in contrast to shorter, staple noncontinuous fibers produced by prior meltblown processes, such as the one described in International Publication No. WO98/26122.

The dope is delivered at somewhat elevated temperature to the spinning apparatus by a pump or extruder at temperatures from 70° C. to up to about 140° C. The temperature of the dope should not be so high that rapid decomposition of the solvent occurs or so low that the dope becomes brittle and unspinnable. Regenerating solutions are nonsolvents such as water, a water-NMMO mixture, lower aliphatic alcohols, or mixtures of these. The NMMO used as the solvent can then be recovered from the regenerating bath for reuse. Preferably the regenerating solution is applied as a fine spray at some predetermined distance below the extrusion head.

Figure 2:
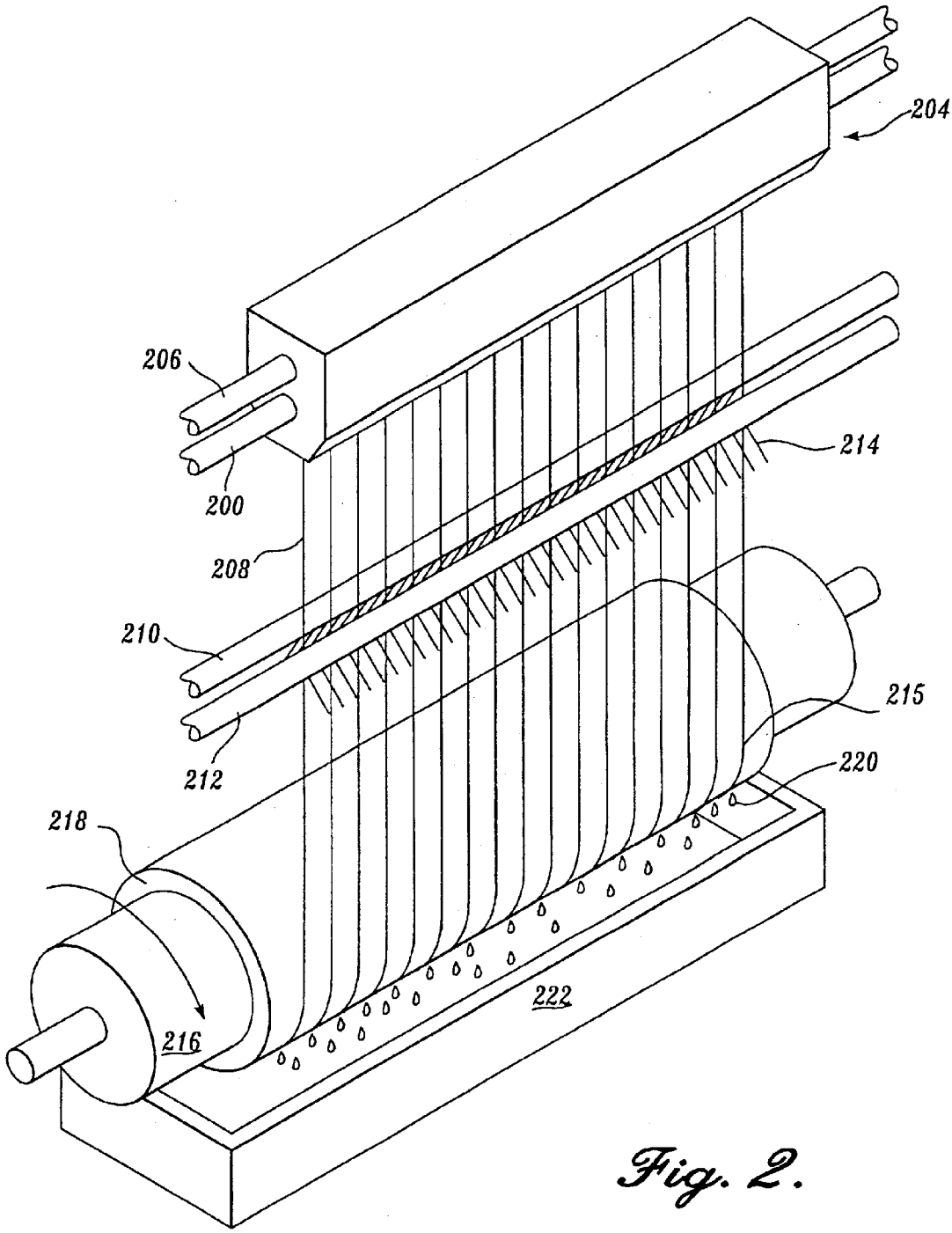
FIG. 2 illustrates one embodiment of an apparatus of carrying out a process for forming filaments in accordance with the present invention.

FIG. 2 shows details of a presently preferred embodiment of a modified melt blowing process formed in accordance with the present invention. A supply of dope is directed through an extruder and positive displacement pump, not shown, through line 200 to an extrusion head 204 having a multiplicity of orifices. Compressed air or another gas is supplied through line 206. Latent filaments 208 are extruded from orifices 340 (seen in FIG. 3) in the Z-direction. These thin strands of dope 208 are picked up by the high velocity gas stream traveling in the Z-direction created by air exiting intermittent slots 344 (FIG. 3) in the extrusion head. The filaments are significantly stretched or elongated as they are carried downward by the air stream. At an appropriate point in their travel the now stretched latent filaments strands 208 pass between opposing spray pipes 210, 212 and are contacted with a water spray or other regenerating liquid 214. The regenerated filaments 215 are picked up by a rotating pickup roll 216 which serves as the source of the external force that causes the mechanical attenuations of the filaments. As the pickup roll begins to fill up, a new roll 216 is brought in to stretch and collect the filaments without slowing production, much as a new reel is used on a paper machine.

The surface speed of roll 216 is faster than the linear speed of the descending filaments 215 so that the filaments are mechanically drawn. The mechanical force exerted on the filaments by the take up device is related to the surface speed of the roll 216, the rate that the filaments are carried by the gas stream, and the speed the dope is expelled from the orifices. Alternatively, a moving foraminous belt may be used in place of the roll to collect and mechanically stretch the filaments and direct them to any necessary downstream processing. In accordance with the present invention, the roller is operated above a minimum surface speed that imparts at least some mechanical attenuation to the filaments. The maximum speed at which the roller can be operated will be determined by a number of factors including the maximum speed at which a continuous filament can be formed. At the lower winder speeds, the filament will tend to be larger in diameter as opposed to a filament formed when the roller is operated at a higher speed. Continuous filaments have been made using winder speeds ranging from about 200–1000 meters/minute. It should be understood that the present invention is not limited to a specific type of take up device, other types of take up devices such as conveyers, belts, rollers, and the like can provide satisfactory results.

The regeneration solution containing diluted NMMO or other solvent drips off the accumulated fiber 220 into container 222. From there it is sent to a solvent recovery unit where recovered NMMO can be concentrated and recycled back into the process.

Figure 3:
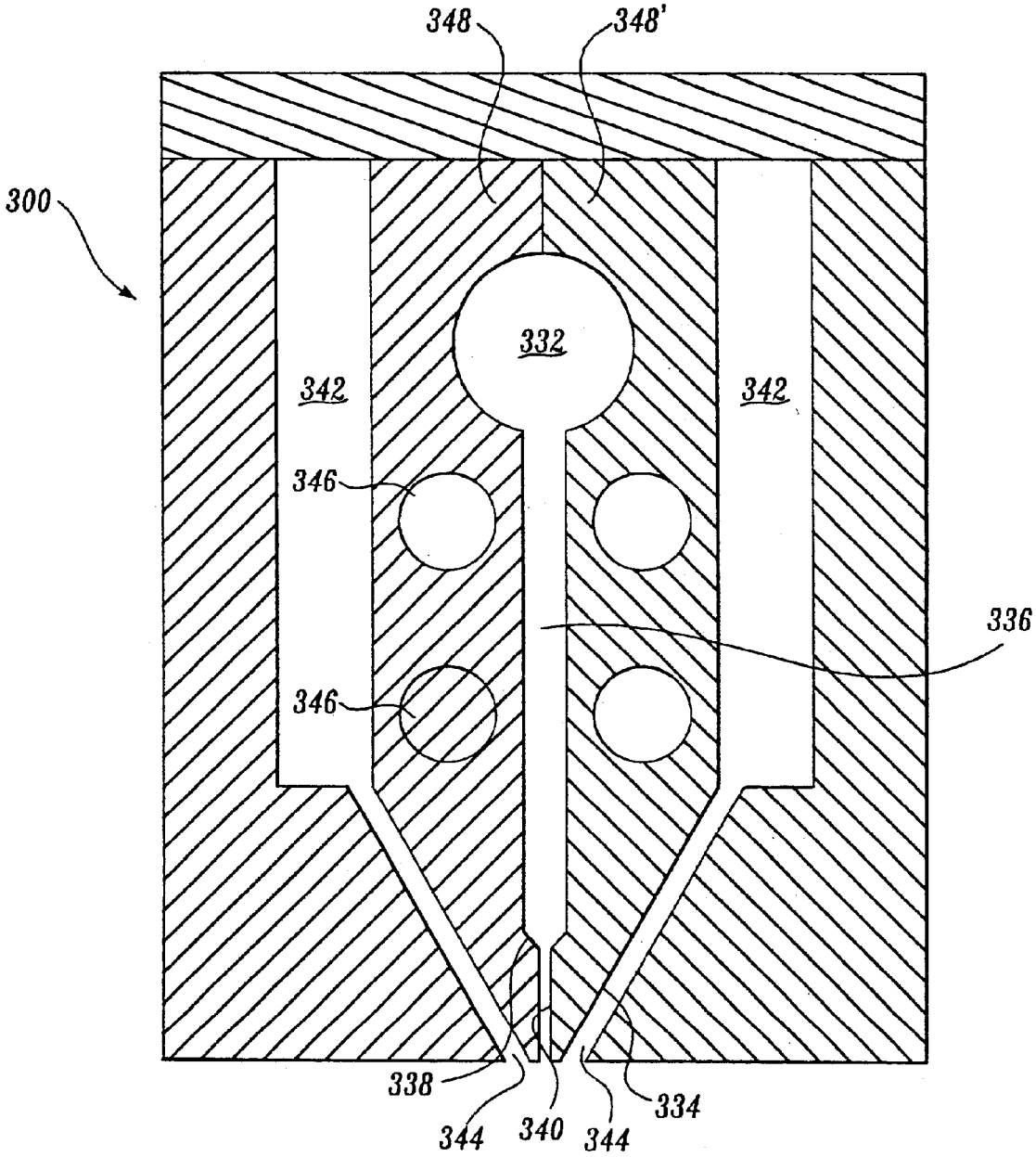
FIG. 3 is a cross-sectional view of an extrusion head useful with the melt blowing apparatus of FIG. 2.

FIG. 3 shows a cross section of a presently preferred extrusion head 300 useful in the presently preferred process. A manifold or dope supply conduit 332 extends longitudinally through the nosepiece 340. Within the nosepiece a capillary or multiplicity of capillaries 336 descend from the manifold. These decrease in diameter in a transition zone 338 into the extrusion orifices 340. Gas chambers 342 also extend longitudinally through the die. These exhaust through slits 344 located adjacent the outlet end of the orifices. Slits or slots 344 are located intermittently along the length of head 300, centered on the orifices 340. The width and length of slots 344 can vary depending upon a number of factors, such as the volume of air which is desired to flow through slots 334 as well as the desired velocity of the gas exiting slots 334. Generally, smaller slots will provide higher velocity gases for a given pressure within chamber 342, and larger slots will provide lower gas velocities at similar pressures in chamber 342. For the orifice diameters described below, slots having a width on the order of 0.01 inches and a length of 0.25 inches have been found to be suitable. Internal conduits 346 supply access for electrical heating elements or steam/oil heat. The gas supply in chambers 342 is normally supplied preheated but provisions may also be made for controlling its temperature within the extrusion head itself.

As discussed above, the dope is extruded into a flowing gas stream which travels in a direction substantially parallel to the direction that the dope is extruded through orifice 340. Gas exiting slits 344 join at some predetermined angle to form a single jet which flows along the axis dividing the angle formed by the two opposing streams of gas. In the illustrated embodiment of FIG. 3, the jets exiting slits 344 join at an included angle of 60° and merge to form a single jet which flows parallel to the direction that the dope is extruded through slit 340. Accordingly, the mean air direction is provided in a direction that is substantially parallel to the direction that the dope is extruded from slot 340 and the direction that the latent filaments travel.

While FIG. 3 illustrates a preferred embodiment of an extrusion head useful in accordance with the present invention, it should be understood that other types of extrusion heads are useful in accordance with the present invention. For example, the extrusion heads described in U.S. Pat. No. 4,380,570 and U.S. Pat. No. 5,476,616 are examples of useful extrusion heads. Another suitable extrusion head is described in GB 2337957A to Law.

The capillaries and nozzles in the extrusion head nosepiece of FIG. 3 can be formed in a unitary block of metal by any appropriate means such as drilling or electrodischarge machining. Alternatively, due to the relatively large diameter of the orifices, the nosepiece may be machined as a split die with matched halves 348, 348" (FIG. 3). This presents a significant advantage in machining cost and in ease of cleaning.

Spinning orifice diameter may be in the 300–600 μm range, preferably about 400–500 μtm with a L/D ratio in the range of about 2.5–10. Most desirably a lead in capillary of greater diameter than the orifice is used. Capillaries that are about 1.2–2.5 times the diameter of the orifice and that have a L/D ratio of about 10–250 are suitable. Larger orifice diameters utilized in the presently preferred apparatus and method are advantageous in that they are one factor allowing greater throughput per unit of time, e.g., throughputs that equal or exceed about 1 g/min/orifice. Further, larger diameter orifices are not nearly as susceptible to plugging from small bits of foreign matter or undissolved material in the dope as are the smaller nozzles. The larger nozzles are much more easily cleaned if plugging should occur and construction of the extrusion heads is considerably simplified, in part due to lower pressures required. Operating temperature and temperature profile along the orifice and capillary preferably fall within the range of about 70° C. to about 140° C. to avoid a brittle dope or rapid solvent degradation. It appears beneficial to have a rising temperature near the exit of the spinning orifices. There are many advantages to operation at as high a temperature as possible, up to about 140° C. where NMMO begins to rapidly decompose. Among these advantages, throughput rate may generally be increased due to a reduction of viscosity at higher dope temperatures. By profiling orifice temperature, the decomposition temperature may be safely approached at the exit point since the time the dope is held at or near this temperature is very minimal. Air temperature as it exits the melt blowing head can be in the 40–140° C. range, preferably about 70° C.

The minimum velocity of the gas stream is preferably greater than the velocity of the dope exiting the orifices so that at least some attenuation of the formed filament is caused by the gas stream. The gas maximum velocity will depend on the end result desired. At some maximum velocity staple (discontinuous) fibers will be formed, as opposed to continuous filaments which tend to be produced at lower gas velocities. The gas velocity can be adjusted in relation to the surface speed of the roller and dope flow rate to tailor the amount of non-mechanical stretching imparted by the gas stream compared to the mechanical stretching imparted by the take up device. For example, gas pressure at the entrance to 0.25 inch long and 0.010 inch wide slots 344 ranging from about 0.60 to about 19 psi provide gas velocities of just greater than zero (0) up to sonic. As a specific example, an air pressure in chambers 342 of about 4.0 psi provides an air velocity at the exit of slots 344 of approximately 175 meters/second when the slots 344 are 0.25 inch long and 0.01 inch wide. This flowing air slows down dramatically upon exiting the slots 344 as it entrains stagnant air from the sides into the expanding jet created by these flowing gas jets. In accordance with the present invention, the slow down of the air should not be so great that the air stream velocity falls below the speed that the filaments are extruded from the orifice.

Varying the humidity of the gas can affect the properties of the produced fibers, for example air with a higher humidity tends to produce fibers that have smaller diameters, as compared to fibers made using air with a lower humidity.

It has been observed that with mechanical attenuation being applied by the take up device, there is an advantage to providing a minimum gas flow, insufficient to impart any non-mechanical (e.g., gas) attenuation, yet sufficient to stabilize the filaments for stretching by the winder. As described above, in conventional dry-jet wet process, no air flow or a transverse air flow is provided in the air gap and it is believed that the absence of an air flow in this air gap parallel to the direction the dope exits the orifices adversely affects the degree to which the dry-jet wet process can be controlled. For example, it is believed that the provision of a minimal gas flow (i.e., insufficient to attenuate the filaments) parallel to the direction the dope exits the die in a conventional dry-jet wet process will stabilize the formed filaments from lateral movements which otherwise may result in adjacent filaments becoming fused to each other. In addition, a minimal gas flow parallel to the direction the dope exits the die may avoid spring back of the latent filaments which can result in the formation of loops due to the elasticity of the latent filaments. An additional benefit of providing a gas flow parallel to the direction the dope exits the die relates to the ability to assist in guiding the filaments to the take up device after they are initially formed by the die.

Lyocell filaments having the following properties have been produced by a process carried out in accordance with the present invention:

| | |
|---|---|
| Fineness: | about 2.2 to 0.5 dtex |
| Dry Tenacity: | about 33 to 42 cN/tex |
| Wet Tenacity: | about 22 to 28 cN/tex |
| Dry Elongation: | about 11% to 14% |
| Wet Elongation: | about 12% to 15% |
| Loop Tenacity: | about 13 to 18 cN/tex |
| Dry Modulus: | about 670 to 780 cN/tex |
| Wet Modulus: | about 170 to 190 cN/tex |
| Bundle Strength: | about 33 to 47 cN/tex |
| Diameter variability along fiber | about 6 to 17 CV % |
| Diameter variability between fibers | about 10 to 22 CV % |
| Fibrillation index: | about 0 to 1 |
| Dyeability | Good |

Smooth Surface texture which can be varied depending on degree of stretch

Processes carried out in accordance with the present invention are believed to provide unique opportunities to tailor the properties of lyocell fibers produced using such methods. By adjusting the orifice diameter, viscosity of the dope, rate of extrusion, gas velocity, and speed of the take-up device, lyocell filaments of less than one denier can be produced in accordance with the present invention. Specific examples of properties of lyocell filaments produced by a process carried out in accordance with the present invention are described below.

COMPARATIVE EXAMPLE 1

Dry-Jet Wet

This comparative example illustrates the production of lyocell fibers using a dry-jet wet process without air attenuation. Dope was prepared from an acid treated pulp described in International Publication No. WO99/47733 having a hemicellulose content of 13.5% and an average cellulose degree of polymerization of about 600. The treated pulp was dissolved in NMMO to provide a cellulose concentration of about 12 weight percent and spun into filaments by a dry-jet wet process as described in U.S. Pat. No. 5,417,909. The dry-jet wet spinning procedure was conducted by Thuringisches Institut fur Textil-und Kunststoff-Forschung. V., Breitscheidstr 97, D-07407 Rudolstadt, Germany (TITK) and employed a stagnant air gap or an air gap where the air flow was transverse to the direction the filaments traveled. The procedure produced filaments which were cut into staple fibers. The properties of the fibers prepared by the dry-jet wet process are summarized in Table 1 below as DJW-TITK.

COMPARATIVE EXAMPLE 2

Melt Blowing Without Mechanical Attenuation

This comparative example illustrates the production of lyocell filaments using a melt-blowing process without mechanical attenuation. A dope was prepared from an acid treated pulp described in Example 10 of International Publication WO99/47743 having a hemicellulose content of 13.5% and an average degree of polymerization of about 600.

The acid treated pulp was dissolved in NMMO. Nine grams of the dried, acid-treated pulp were dissolved in a mixture of 0.025 grams of propyl gallate, 61.7 grams of 97% NMMO and 21.3 grams of 50% NMMO producing a cellulose concentration of about 9.8%. The flask containing the mixture was immersed in an oil bath at about 120° C., a stirrer was inserted, and stirring was continued for about 0.5 hours until the pulp dissolved.

The resulting dope was maintained at about 120° C. and fed to a single orifice laboratory melt blowing head. Diameter at the orifice of the nozzle portion was 483 $\mu$m and its length about 2.4 mm, a L/D ratio of 5. A removable coaxial capillary located immediately above the orifice was 685 $\mu$m in diameter and 80 mm long, a L/D ratio of 116. The included angle of the transition zone between the orifice and capillary was about 118°. The air delivery ports were parallel slots with the orifice opening located equidistant between them. Width of the air gap was 250 $\mu$m and overall width at the end of the nosepiece was 1.78 mm. The angle between the air slots and centerline of the capillary and nozzle was 30°. The dope was fed to the extrusion head by a screw-activated positive displacement piston pump. Air velocity was measured with a hot wire instrument as 3660 m/min. The air was warmed within the electrically heated extrusion head to 60–70° C. at the discharge point. Temperature within the capillary without dope present ranged from about 80° C. at the inlet end to approximately 140° C. just before the outlet of the nozzle portion. It was not possible to measure dope temperature in the capillary and nozzle under operating conditions. When equilibrium running conditions were established a continuous fiber was formed from the dope. Throughput was greater than about 1 gram of dope per minute.

A fine water spray was directed on the descending filaments at a point about 200 mm below the extrusion head and the filaments were taken up on a roll operating with a surface speed about ¼ the linear speed of the descending filaments. The properties of the collected fibers are summarized in Table 1 below under the heading MB.

The following Examples 1–3 illustrate and describe embodiments of a process for producing lyocell filaments in accordance with the present invention and are intended for illustrative purposes and not for purposes of limiting the scope of the present invention.

EXAMPLE 1

A dope for forming lyocell filaments was made by dissolving in N-methyl morpholine N-oxide a kraft pulp having an average degree of polymerization of about 600 as measured by ASTM D 1795-62, and a hemicellulose content of about 13% as measured by a Weyerhaeuser Company Dionex sugar analysis method. The cellulose concentration in the dope was 12% by weight. The dope was extruded from a meltblowing die that had 20 nozzles having an orifice diameter of 457 microns at a rate of 0.625 grams/hole/minute. The orifices had a length/diameter ratio of 5. The die was maintained at a temperature ranging from 100 to 130 degrees Celsius. The dope was extruded into an air gap 12.7 centimeters long before coagulation with a water spray. Air at a temperature greater than 90 degrees Celsius and a pressure of 20 psi was supplied to the head. The air pressure in the air cap (chamber 342 in FIG. 3) was about 4.0 psi and flowed at a rate of about 18 SCFM. This provided an air velocity at the exit to the air slots of about 175 meters/second. In this example, the slots were 0.25 inches long and 0.010 inches wide.

Downstream of the air gap, the formed filaments were taken up by a winder operating at a speed of 500 meter/minute which was greater than the linear speed of the filaments in the air gap. Water was used to precipitate the cellulose from the formed filaments. The water was applied by spraying it onto the filaments in advance of the winder. Four different samples were made using the above process. The samples were designated MBA-1 through MBA-4.

Figure 4:
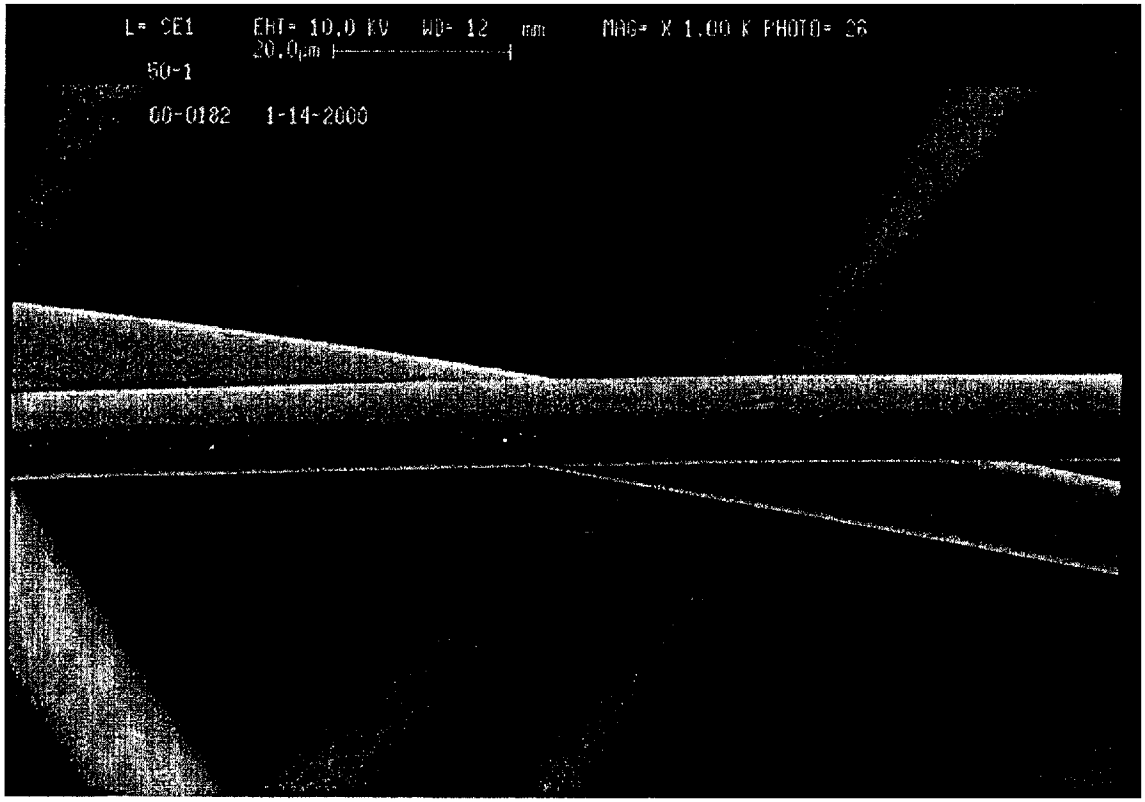
FIG. 4 is a 1000× scanning electron micrograph of a lyocell filament formed by a process carried out in accordance with one embodiment of the present invention after being subjected to a fibrillation test described in Example 1.
Figure 5:
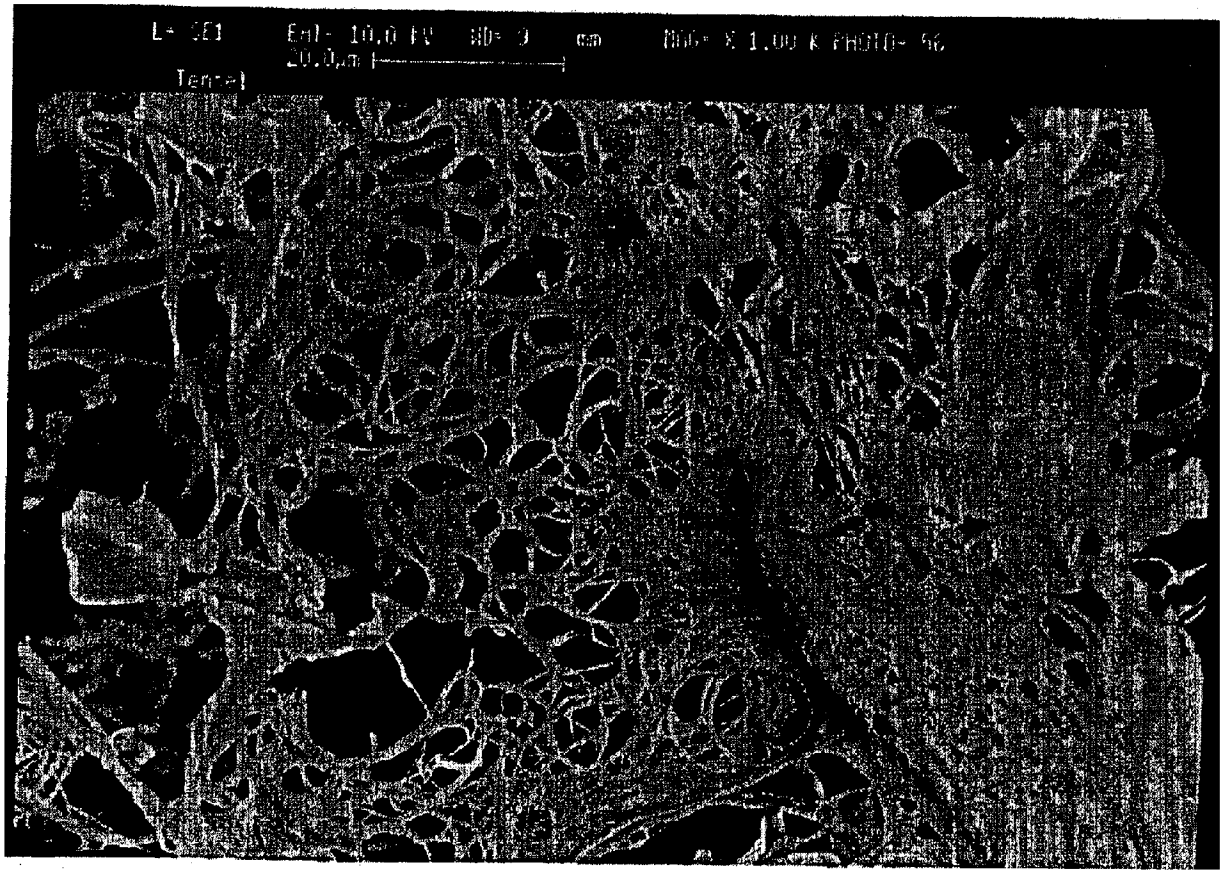
FIG. 5 is a 1000× scanning electron micrograph of commercially available Tencel® lyocell fibers after being subjected to the same fibrillation test as the filaments of FIG. 4.

The collected filaments were washed and dried and then subjected to the following procedures to assess their fineness (TITK test using DIN EN ISO 1973), dry tenacity (TITK tests using DIN EN ISO 5079), dry elongation (TITK test using DIN EN ISO 5079), wet tenacity (TITK test using DIN EN ISO 5079), wet elongation (TITK test using DIN EN ISO 5079), relative wet tenacity (i.e., wet tenacity/dry tenacity), loop tenacity (TITK test using DIN 53 843 T2), dry modulus (TITK test using DIN EN ISO 5079), wet modulus (TITK test using DIN EN ISO 5079), diameter variability CV % (microscope measurement of 200 filaments for among fiber CV % and 200 readings from a bundle strength (stelometer measurement by International Textile Center, Texas Tech University), and fibrillation properties (individualized filaments placed in a 25 milliliter test tube with 10 milliliters of water and shaken at low amplitude at a frequency of about 200 cycles per minute for 24 hours), evaluated on a scale of 0 to 10, with 0 being low or no fibrillation as exemplified in FIGS. 4 and 10 being high fibrillation as exemplified in FIG. 5. The abbreviation "TITK" referred to above identifies the German company, Thuringisches Institut fur Textil und Kunststoff-Forschung eV, that performed the described tests.

The properties of the filaments MBA-1 through MBA-4 are summarized in Table 1.

The fibrillation index was determined by viewing SEM photos of about 100 filament segments about 10 microns in length. If 0 to 1 fibril/segment was observed, the fiber was rated 0. If each segment included 5–6 fibrils or the segments became fragmented as in FIG. 5, a rating of 10 was assigned.

TABLE 1

| | Sample | | | | | | | |
|---|---|---|---|---|---|---|---|---|
| | DJW-Newcell ® filament | MBA-1 | MBA-2 | MBA-3 | MBA-4 | DJW-TITK | DJW-TENCEL | MB |
| Pulp | — | Kraft | Kraft | Kraft | Kraft | Kraft | — | Kraft |
| Fineness (dtex) | 0.9–3.03 | 1.72 | 1.74 | 2.15 | 2.17 | 1.77 | 1.70 | 1.21 |
| Tenacity dry (cN/tex) | 30–42 | 37.7 | 34.7 | 34.6 | 33.3 | 35.9 | 44.2 | 27.7 |
| Tenacity wet (cN/tex) | 20–27 | 25.5 | 24.5 | 26.1 | 22.7 | 27.8 | 32.4 | 18.2 |
| Relative tenacity (%) | — | 68 | 71 | 75 | 68 | 77 | 73 | 66 |
| Elongation dry (%) | 6–10 | 12.3 | 12.1 | 13.4 | 11.1 | 13.0 | 13.8 | 11.4 |
| Elongation wet (%) | 8–13 | 13.0 | 13.4 | 14.6 | 12.0 | 14.0 | 14.5 | 14.9 |
| Loop tenacity (cN/tex) | 18–29 | 17.8 | 17.6 | 13.9 | 13.4 | 9.6 | 10.5 | 9.1 |
| Modulus dry (cN/tex) | — | 752 | 672 | 701 | 777 | 519 | 829 | 666 |
| Modulus wet (cN/tex) | — | 188 | 180 | 181 | 170 | 176 | 212 | 123 |
| Diameter variability CV % (among fibers) | — | 21.58 | 10.12 | 11.01 | 13.88 | 7.3 | 5.2 | 29.5 |
| Diameter Variability CV % (along fibers) | — | 7.5 | 6.9 | 8.3 | 7.8 | 6.1 | 5.2 | 13.2 |
| Bundle strength (cN/tex) | — | 44.00 | 45.23 | 46.07 | 33.77 | — | — | — |
| Bundle Elongation (%) | — | 10.33 | 10.08 | 10.33 | 7.83 | — | — | — |
| Fibrillation index (estimated from fibrils in SEM) | — | 1 | 0 | 0 | 0.5 | 10 | 10 | 0 |
| Average diameter (micron) | — | 12.4 | 13.1 | 14.2 | 13.40 | 13.5 | 13.5 | 11.2 |

The resulting filaments MBA-1 through MBA-4 possess similar tenacity as commercial lyocell filaments made by a dry-jet wet process available from Newcell GmbH & Co. KG, Kasino Str., 19–21 D-42103 Wuppertal as Newcell® (DJW-Newcell®), but have higher dry elongation than such commercial filaments.

The filaments of Example 1 also have higher loop strength compared to lyocell staple fibers prepared from similar dopes using the TITK dry-jet wet method described in comparative Example 1. The filaments of Example 1 also have higher dry modulus compared to lyocell staple fibers prepared from similar dopes using the TITK dry-jet wet method of comparative Example 1. In addition, using the test described above, the filaments of Example 1 have lower tendency to fibrillate than commercial lyocell fibers produced by a dry-jet wet process available from Accordis Company under the trademark TENCEL® (DJW-Tencel®) and the DJW-TITK fibers. Compared to meltblown lyocell without mechanical stretching (Sample MB), the filaments of Example 1 (MBA-1 through MBA-4) have higher dry and wet tenacity, and lower diameter variability both among and along the filaments. This example illustrates properties of lyocell filaments having a fineness on the order of 1 denier produced in accordance with the present invention. Lyocell filaments having a denier less than 1 can be produced by adjusting the dope viscosity, dope throughput in the orifices, and the winder speed as described below.

The procedure described above was repeated with dope samples prepared as described above. For Samples MBA-5 through MBA-17 set forth in Table 2, the dopes were spun under the conditions described above except that the winder speed was set at either 220 meters/minute, 350 meters/minute, 400 meters/minute, or 600 meters/minute. The diameter and coefficient of variability for the diameter is set forth in Table 2 below for samples MBA-5 through MBA-17. For Samples MBA-18 and MBA-19, the dope throughput was reduced to 0.42 grams/hole/minute and 0.25 grams/hole/minute respectively, and the winder speed was 800 meters/minute. The diameter and diameter variability for Samples MBA-18 and MBA-19 are set forth in Table 2. The diameter and diameter variability of filaments MBA-1 through MBA-4 are reported above in Table 1.

TABLE 2

| | SAMPLE | | | | | | | |
|---|---|---|---|---|---|---|---|---|
| | MBA-5 | MBA-6 | MBA-7 | MBA-8 | MBA-9 | MBA-10 | MBA-11 | MBA-12 |
| Average Diameter (micron) | 17.6 | 19.9 | 21.5 | 16.5 | 16.3 | 21.6 | 14.2 | 13.6 |
| Diameter Variability CV % (among fibers) | 15 | 24 | 30 | 23 | 17 | 25 | 23 | 16 |
| Diameter Variability CV % (along fibers) | — | — | — | — | — | — | — | — |
| Winder Speed meters/minute | 220 | 220 | 220 | 350 | 350 | 350 | 500 | 500 |
| Throughput grams/hole/minute | 0.625 | 0.625 | 0.625 | 0.625 | 0.625 | 0.625 | 0.625 | 0.625 |
| | SAMPLE | | | | | | | |
| | MBA-13 | MBA-14 | MBA-15 | MBA-16 | MBA-17 | MBA-18 | MBA-19 | MBA-20 |
| Average Diameter (micron) | 15.7 | 13.6 | 13.2 | 11.8 | 14.7 | 9.4 | 7.2 | 9.4 |
| Diameter Variability CV % (among fibers) | 26 | 19 | 21 | 12 | 16 | 15 | 17 | 21 |
| Diameter Variability CV % (along fibers) | — | — | — | — | — | — | — | — |
| Winder Speed meters/minute | 500 | 500 | 500 | 600 | 400 | 800 | 800 | 900 |
| Throughput grams/hole/minute | 0.625 | 0.625 | 0.625 | 0.625 | 0.625 | 0.420 | 0.250 | 0.625 |

The resulting filaments MBA-5 through MBA-20 generally had lower diameters and lower diameter variability among the filaments compared to meltblown filaments made without mechanical stretching as described above in Comparative Example 1 and below in Comparative Example 2.

Figure 6:
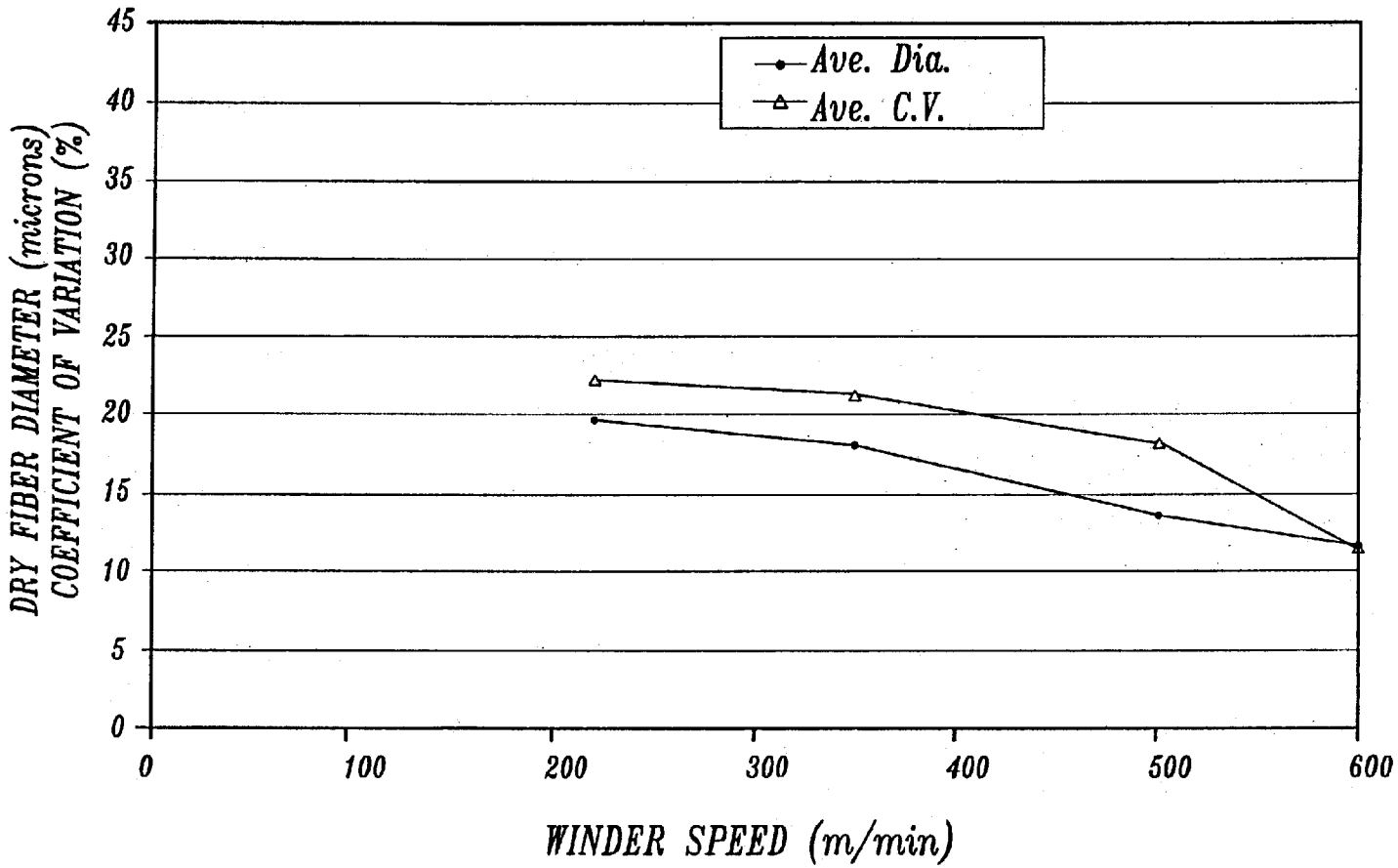
FIG. 6 is a graphical representation of the average fiber diameter and the average coefficient of variability for the MBA filaments of Example 1.

FIG. 6 is a graph representing the average diameter and the average coefficient of variability among the filaments for MBA-1 through MBA-16 produced using the various winder speeds described in Example 1. From the graph, it is observed that as the winder speed increases, the dry filament diameter decreases as well as the coefficient of variation.

COMPARATIVE EXAMPLE 3

In order to produce filaments using a conventional meltblown process without mechanical attenuation, the procedure of Example 1 was repeated using a dope as described in Example 1 with the exception that the winder speed was 0 meters/minute. Under these conditions, the formed filaments had an average diameter of 26.1 microns and a coefficient of variation among filaments of 44%.

EXAMPLE 2

The procedure of Example 1 was repeated using a different air pressure. The winder speed was 500 meters/minute. In this example the pressure of the air supplied to the meltblowing head was 1 psi which resulted in a pressure of about 0.60 in the air cap (chamber 342 in FIG. 3). This low pressure provided a perceptible flow of air in the air gap traveling at a velocity greater than the linear velocity of the filaments exiting the orifices. The air flow was observed to attenuate the extruded filaments. The average diameter of the filaments produced was 14.74 microns. The filament diameter ranged from 64.12 to 7.10 microns.

COMPARATIVE EXAMPLE 4

Dry-Jet Wet

The procedure of Example 1 was repeated using a different air pressure and winder speed. In this example the pressure of the air supplied to this meltblowing head was 0 psi resulting in no flow of air in the air gap. Under these conditions filaments could not be produced at a winder speed of 500 meters/min. At such winder speed with no air flow the extruded dope was observed to break up.

It was observed that in the absence of air flow in the air gap, at start-up of the process the frequency at which the extruded filament would not find its way to the winder was greater compared to the start-up of the process described in Examples 1 and 2 where air flow was provided in the air gap.

EXAMPLE 3

A dope for forming lyocell filaments was made by dissolving in N-methyl morpholine N-oxide, a Kraft pulp having an average degree of polymerization of about 750 as measured by ASTMD1795-62 and a hemicellulose content of about 13% as measured by a Weyerhaeuser Company dionex sugar analysis method. The cellulose concentration in the dope was about 12% by weight. The dope was extruded from a melt blowing die that had 20 nozzles having an orifice diameter of 457 microns at a rate of 0.625 grams/hole/minute. The orifices had a length/diameter ratio of 5. The nozzle was maintained at a temperature ranging from 100° to 130° C. The dope was extruded into an air gap 12.7 cm long before coagulation with a water spray. Air at a temperature greater than 90° C. and a pressure of about 20 psi was supplied to the head. The air pressure in the air cap (Chamber 342 in FIG. 3) was about 4.0 psi and flowed at a rate of about 18 SCFM. This provided an air velocity at the exit to the air slots of about 175 meters/second.

Downstream of the air gap, the formed filaments were taken up by a winder operating at a surface speed of about 900 meters/minute. Water was used to precipitate the cellulose from the formed filaments. The water was applied by spraying it onto the filaments in advance of the winder.

The collected filaments (MBA-20) were washed and dried and then subjected to the tests described above in Example 1 to assess their fineness, dry tenacity, dry elongation, wet tenacity, wet elongation, loop tenacity, and fibrillation properties. The following values were observed:

| | |
|---|---|
| Fineness (dtex) | 1.12 |
| Dry Tenacity (cN/tex) | 42.10 |
| Wet Tenacity (cN/tex) | 28.10 |
| Dry Elongation (%) | 10.60 |
| Wet Elongation (%) | 13.10 |
| Loop Tenacity (cN/tex) | 16.40 |
| Fibrillation Index | 2.00 |
| Average Diameter (microns) | 9.40 |
| Diameter Variability (CV %) | 21.00 |

The embodiments of the invention in which an exclusive property or privilege is claimed are defined as follows:

1. A process for forming lyocell fibers comprising:

forming a dope from cellulose;

extruding the dope through a plurality of orifices into a flowing gas stream;

stretching the filaments with the flowing gas stream to form substantially continuous elongate filaments;

attenuating the filaments by applying an external force to the filaments in a direction parallel to a length of the filaments, the external force being supplied by something other than the gas stream or gravity; and regenerating the filaments.

2. The process of claim 1, wherein the gas stream flows substantially parallel to the direction the dope is extruded through the orifices.

3. The process of claim 1, wherein the external force is provided by a mechanical device.

4. The process of claim 3, wherein the mechanical device is a take-up roller.

5. The process of claim 4, where the take-up roller is operated at a surface speed that is greater than the speed that the filaments are carried by the gas stream.

6. The process of claim 5, wherein the surface speed ranges from about 200 to about 1000 meters/minute.

7. The process of claim 3, wherein the mechanical device is a foraminiferous belt.

8. The process of claim 7, wherein the foraminiferous belt is operated at a surface speed that is greater than the speed that the filaments are carried by the gas stream.

9. The process of claim 8, wherein the surface speed ranges from about 200 to about 1000 meters/minute.

10. The process of claim 1, wherein the step of stretching the filaments with the flowing gas stream decreases the diameter of the filaments.

11. The process of claim 1, wherein the step of applying an external force decreases the diameter of the filaments.

* * * * *